US005092086A

United States Patent [19]

Rognsvoog, Sr.

[11] Patent Number: 5,092,086

[45] Date of Patent: Mar. 3, 1992

[54] GUTTER SHIELD ASSEMBLY

[76] Inventor: Albert Rognsvoog, Sr., 5000 Valley Trail, Racine, Wis. 53402

[21] Appl. No.: 664,855

[22] Filed: Mar. 5, 1991

Related U.S. Application Data

[63] Continuation-in-part of Ser. No. 572,677, Aug. 27, 1990, abandoned.

[51] Int. Cl.[5] ..... E04D 13/06

[52] U.S. Cl. ..... 52/12; 52/94; 248/48.1

[58] Field of Search ..... 210/474; 52/12, 94; 248/48.1

[56] References Cited

U.S. PATENT DOCUMENTS

| | | | |
|---|---|---|---|
| 453,948 | 6/1891 | Smith et al. | 52/12 |
| 706,333 | 8/1902 | Meuser | 52/12 |
| 870,165 | 11/1907 | Hagler et al. | 210/474 |
| 2,284,440 | 5/1942 | Morrissey | 108/30 |
| 2,935,954 | 5/1960 | Matthews et al. | 210/474 |
| 3,053,393 | 9/1962 | McLean | 210/174 |
| 3,067,881 | 12/1961 | Goosman | 210/474 |
| 3,297,285 | 1/1967 | Simmons | 248/48.1 |
| 4,032,456 | 6/1977 | Berce | 210/474 |
| 4,036,761 | 7/1977 | Rankin | 210/474 |
| 4,253,281 | 3/1981 | Ruttenberg | 52/12 |
| 4,254,595 | 3/1981 | Crosslen | 52/11 |
| 4,301,976 | 12/1981 | Butler | 405/118 |
| 4,351,134 | 9/1982 | Clarkson | 52/12 |
| 4,447,994 | 5/1984 | Garneau | 52/11 |
| 4,467,570 | 8/1984 | Kriegel | 52/12 |
| 4,553,356 | 11/1985 | Pepper | 52/11 |
| 4,573,290 | 3/1986 | Fleming | 52/12 |
| 4,644,704 | 2/1987 | Pedgonay | 52/12 |
| 4,745,710 | 5/1988 | Davis | 52/12 |
| 4,750,300 | 6/1988 | Winger, Jr. | 52/12 |
| 4,769,957 | 9/1988 | Knowles | 52/12 |
| 4,841,686 | 6/1989 | Rees | 52/12 |
| 4,856,237 | 8/1989 | Wigle | 52/12 |
| 4,888,920 | 12/1989 | Marulic | 52/12 |
| 4,905,427 | 3/1990 | McPhalen | 52/12 |
| 4,907,381 | 3/1990 | Ealer | 52/12 |
| 4,912,888 | 4/1990 | Martin | 52/12 |
| 4,937,986 | 7/1990 | Way et al. | 52/12 |

*Primary Examiner*—James L. Ridgill, Jr.
*Attorney, Agent, or Firm*—Jansson & Shupe, Ltd.

[57] ABSTRACT

The improved gutter shield assembly is arranged for attachment to a roof constructed of partially overlapping shingles which define thin spaces between them. The shield assembly includes a mesh-like barrier which prevents debris from entering the gutter. The barrier has a plurality of openings for permitting the passage of water from the shingles through the barrier and into the rain gutter below. Attachment devices which are devoid of nails are used to attach the shield assembly. Such attachment devices may include J-shaped hooks, bent tabs or both. The barrier is thereby attached while yet avoiding piercing of shingles and consequent impairment of the rainproof integrity of such shingles. In another embodiment, the barrier is permanently attached to the roof.

6 Claims, 2 Drawing Sheets

GUTTER SHIELD ASSEMBLY

RELATED APPLICATION

This application is a continuation-in-part of application Ser. No. 572,677 filed on Aug. 27, 1990, and now abandoned.

FIELD OF THE INVENTION

This invention is related generally to gutter shields and, more particularly, to a rain gutter shield assembly which is readily attached and secured in place without the use of nails or other shingle-piercing fasteners and which is easily removed.

BACKGROUND OF THE INVENTION

Unless precautions are taken, rain gutters mounted on the roofs of buildings can and often do become obstructed and eventually clogged with debris. Certainly, falling leaves are the most frequent cause of gutter clogging but certainly not the only cause. Small twigs and branches commonly fall or are washed into rain gutters as a result of storms and high winds. Birds occasionally nest in rain gutters and such nests, being relatively large cohesive masses, can quickly and completely clog a rain gutter. Any of the foregoing will require the building occupant to free such rain gutters of debris. Otherwise, the gutter overflows and leaking foundations and basements often result.

Devices to shield rain gutters and prevent debris from being deposited in them are well known. For example, U.S. Pat. No. 4,032,456 (Berce) shows a gutter shield which uses a mesh cover supported by a solid frame and mounted to the roof using a strap-like hinge. Each hinge is affixed to the roof by shingle-piercing nails although an adhesive may be used for attachment if the hinge is perforated. The Berce shield is clearly intended for permanent mounting on the roof, the mesh shield being attached along only one edge so that the shield can be flipped upward for cleaning access to the gutter.

Another type of gutter shield is shown in U.S. Pat. No. 4,573,290 (Fleming). The Fleming shield is made entirely of mesh and is attached to the roof using nails which are driven through layers of overlapping shingles and into the underlying roof structure. In the alternative or in addition to the use of nails, cement bonding can be used. In either instance, the installation is clearly permanent and not intended for removal or, very possibly, for easy access to the interior of the gutter.

The screen shown in U.S. Pat. No. 4,745,710 (Davis) has a lower edge which is secured to a rain gutter and an upper plate which is merely inserted between layers of shingles without apparent use of adhesive or other fastening means.

Still another type of gutter guard is shown in U.S. Pat. No. 4,769,957 (Knowles). The front edge of the Knowles guard is attached to the front edge of the rain gutter using fasteners such as pop rivets or sheet metal screws. Retention of the rear or upper edge is by inserting such edge beneath the leading edges of the first course of shingles.

While the aforementioned shields and guards have been generally satisfactory for their intended purposes, they have certain disadvantages. In particular, each has an upper edge which is either permanently attached to the roof shingles by bonding or nails (the Fleming and Berce guards) or which is not attached to the roof at all except by insertion between shingles (the Knowles and Davis guards). In the latter instance, the lower edge of the shield is more or less permanently attached to the gutter. In any case, the resulting shield is difficult and time consuming to install and, if necessary, to remove.

Yet another disadvantage of such known shields is that their structures tend to be somewhat complex and require a number of different elements as with the Berce and Davis shields, for example. Others, like the Knowles gutter guard, use both plate and mesh elements to form the guard, the former being required to be bent or otherwise shaped as part of the manufacturing process.

An improved gutter shield assembly which is attachable to a roof without the use of nails or other shingle-piercing fasteners, which attaches to both the roof shingles and the front lip of the gutter, which is readily installed and removed and which embodies simplified construction and therefore is of lower cost, which would be an important advance in the art.

OBJECTS OF THE INVENTION

It is an object of this invention to overcome some of the problems and shortcomings of the prior art.

Another object of this invention is to provide a gutter shield assembly which is attached to both the roof shingles and the rain gutter without the use of single-piercing fasteners.

Yet another object of this invention is to provide a gutter shield assembly which, in certain embodiments, is easily attached and removed.

Still another object of this invention is to provide a gutter shield assembly which, in another embodiment, is permanently incorporated during building construction.

Another object of this invention is to provide a gutter shield assembly which embodies low cost construction.

These and other important objects will be apparent from the descriptions of this invention which follow.

SUMMARY OF THE INVENTION

The improved gutter shield assembly is arranged for attachment to a roof constructed of partially overlapping shingles which define thin spaces between them. The shield assembly includes an elongate barrier which prevents debris from entering the gutter. This barrier has a plurality of openings for permitting the passage of water from the shingles through the barrier and into the rain gutter below.

Fastening means which are devoid of nails are used for attaching such barrier to the shingles and the gutter. Such fastening means includes a plurality of generally J-shaped hooks for securing the barrier to the roof.

Each hook includes a curved lower end for connection to the barrier and an upper end for securing the assembly to the roof. At least one surface of the upper end of each hook is coated with a soft deformable material. When the upper end of the hook is inserted in the very thin space between partially overlapping shingles, it is retained there by engagement of the deformable material with at least one of the shingles defining such space.

Such fastening means may also include tabs formed in the barrier and positioned to be bent to engage the lower edge or extension of the lower course of shingles. Such tabs may be used in lieu of or in addition to the J-shaped hooks. The assembly is thereby removably attachable to the roof while yet avoiding piercing the shingles with nails or similar fasteners. As used herein, "nail" and "nails" includes nail-like or other fasteners which attach by piercing.

In a highly preferred embodiment, the barrier is formed of a mesh-like material having interwoven wire strands which define spaces between the strands. Galvanized wire screening or cloth is highly suitable as a barrier material. Other materials, a plastic mesh for example, may also be suitable. A preferred barrier material is flexible and retains a shape to which it is bent. Such barrier characteristics permit the barrier to be bent to a shape conforming to that of the front lip of the gutter.

Each hook is preferably formed of a generally flat, strip-like material, the lower curved end of which has a width selected to fit through a space between the wire strands of the barrier with slight clearance. Better attachment of the hook and the shingles results if the soft deformable material is applied to both the top and bottom surfaces of the upper end of the hook. When such upper end is inserted in the thin space between partially overlapping shingles, the rough textured surface of the shingle "bites into" and engages with such soft material. This biting engagement between the shingles and the hook retains the hook but yet permits simple, removable attachment of the assembly to the roof.

It is noteworthy that attachment of the inventive assembly to the shingles and to the gutter is accomplished while yet avoiding the use of piercing-type fasteners on the shingles or on the gutter lip. Since neither nails nor bonding adhesive are required (or desired) for attaching the hook to the shingles, a highly preferred hook is devoid of nail holes, perforations and indentations which might otherwise be required to provide good bonding of an adhesive to the hook.

DETAILED DESCRIPTIONS OF PREFERRED EMBODIMENTS

The figures show an improved gutter shield assembly 10 in accordance with the invention.

Figure 1:
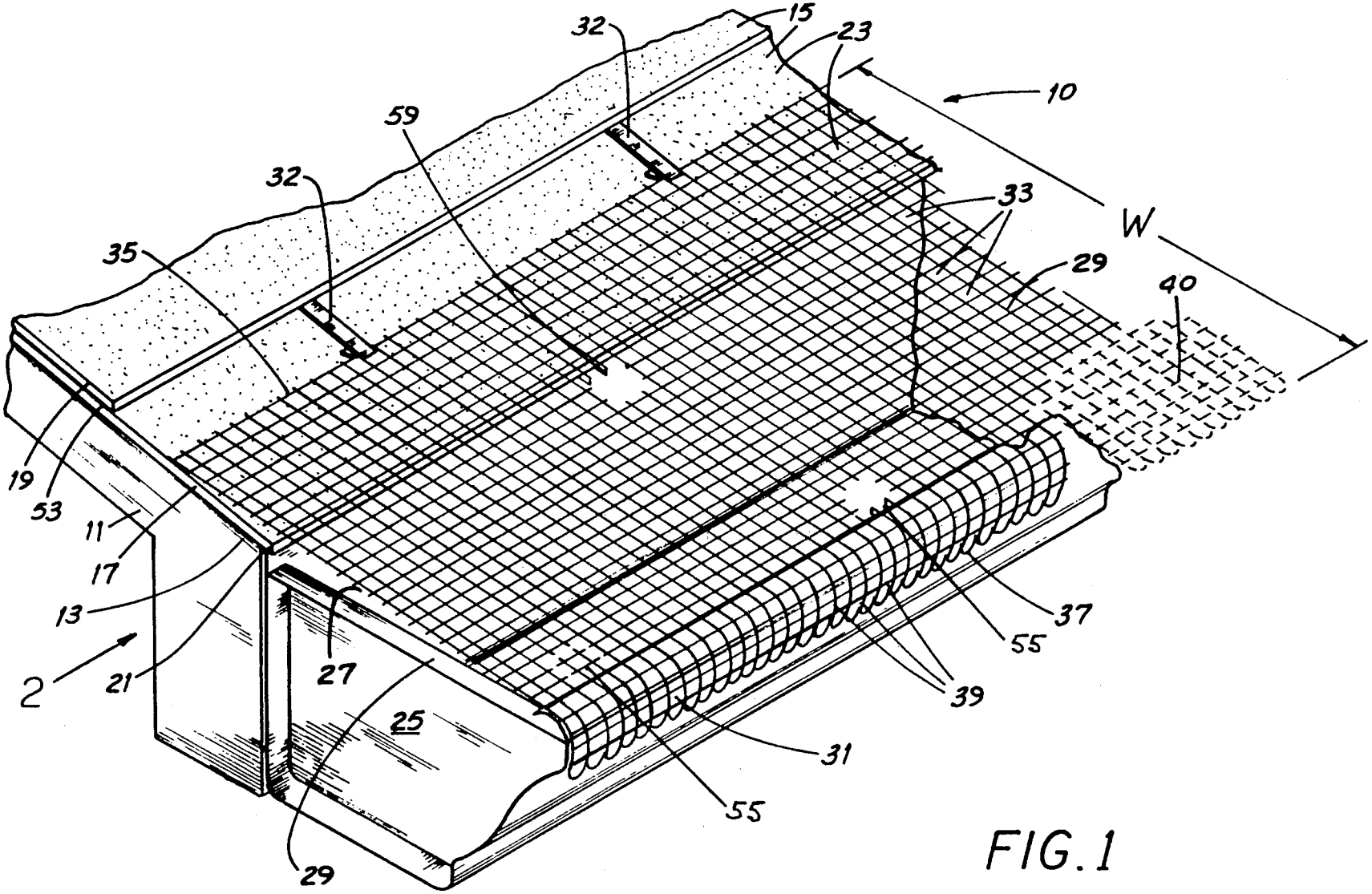
FIG. 1 is a perspective view of the improved gutter shield assembly, with a segment of the assembly shield shown in dotted outline with parts broken away, the assembly being shown in conjunction with a roof with a rain gutter attached thereto.

Referring first to FIG. 1, the shield assembly 10 is shown in conjunction with a roof 11 which has a lower edge 13 and is constructed of shingles 15 conventionally arranged in courses 17, 19. The lower or first course 17 of shingles 15 is arranged horizontally along the edge 13 and has an extension 21 which slightly overlaps the edge 13 in a conventional manner.

A second course 19 of shingles 15 is laid atop the lower course 17 in a conventional manner, i.e., in such a way that the second course 19 partially but not entirely overlaps the lower course 17. Such partial overlap results in an exposed upper surface 23 on the lower course 17. An elongate rain gutter 25 is attached to the edge 13 of the roof 11 and has an interior trough 27, an upper rim 28 and a protruding front lip 31 arranged along the length of the gutter 25.

As used herein, the term "shingle" means a conventional asphalt shingle. Such term also means other types of roof coverings, cedar shakes or tiles for example, which are arranged in partially overlapping fashion and which have thin spaces or interstices between them when installed.

The improved gutter shield assembly 10 includes a barrier 29 and a plurality of hooks 32. In a highly preferred embodiment, the barrier 29 is made of a flexible, mesh-like material having a plurality of openings 33 for permitting water which flows down the shingles 15 to flow into the trough 27. Such openings 33 are sufficiently large and sufficiently closely spaced to one another to permit the free passage of water while at the same time preventing the entry of leaves, sticks and other clogging debris from entering the trough 27.

In a highly preferred embodiment, the barrier 29 is made of galvanized wire screening, sometimes called wire "cloth," which has an upper boundary 35 and a lower boundary 37 arranged generally parallel to one another. The barrier 29 is made of interwoven wire strands 39 with spaces or openings 33 between the strands 39. One type of such screening has openings 33 which are about one-quarter inch square. Such openings 33 have been found acceptable both for water passage and for the attachment of the hooks 32.

Figure 2:
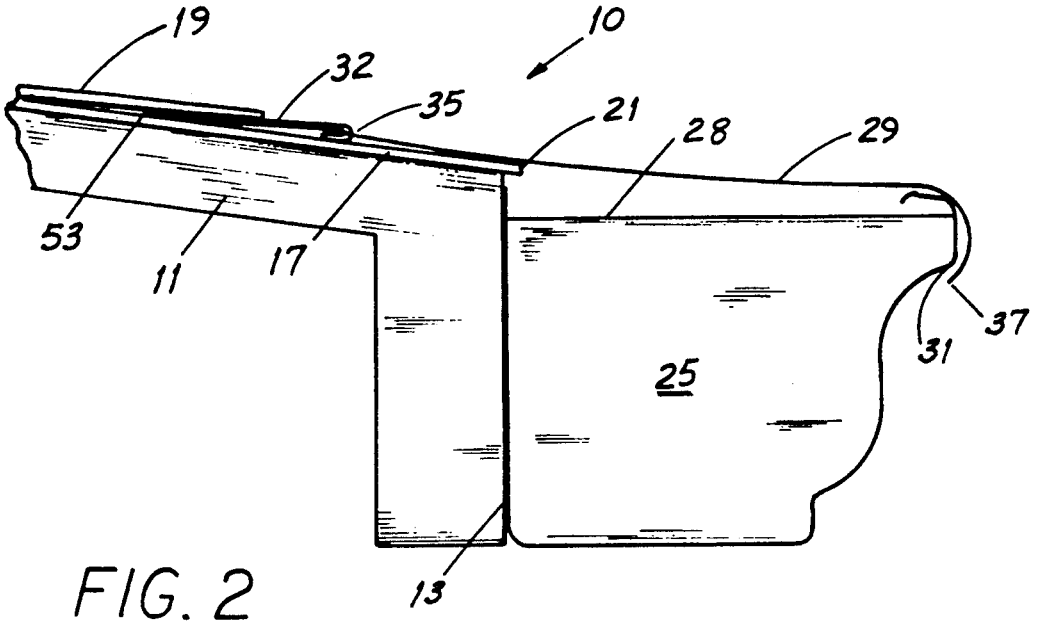
FIG. 2 is a side elevation view of the gutter shield assembly, roof and rain gutter of FIG. 1 taken along the viewing axis 2 thereof.

A preferred barrier material may be readily bent to a shape and will retain such bent shape until flexed and formed into another shape. As shown in FIGS. 1 and 2, flexibility and shape retention permit the barrier 29 (which is substantially flat prior to installation as symbolically illustrated by the dotted portion 40 is FIG. 1) to be installed in overlapping, shape conforming engagement with the front lip 31. Such engagement is accomplished by bending the barrier 29 downward around and under the front lip 31 to secure the barrier 29 to the lip 31. From the foregoing it will be appreciated that other materials may be used to construct 33 therethrough are positioned for hook attachment (as described below) and so long as the material is flexible and has a shape retaining characteristic.

In a highly preferred embodiment, the barrier 29 has a width "W" as shown in FIG. 1. Such width "W" is selected so that the barrier 29 overlaps a substantial portion of the exposed upper surface 23 of the lower course 17 of shingles 15 and also overlaps the front lip 31 to the degree necessary to permit bending the barrier 29 to engage the lip 31 as shown in FIG. 2. As to length, the barrier 29 is conveniently supplied in strips of discrete length or in a variety of discrete lengths. Lengths of about 3 feet are preferred.

Figure 3:
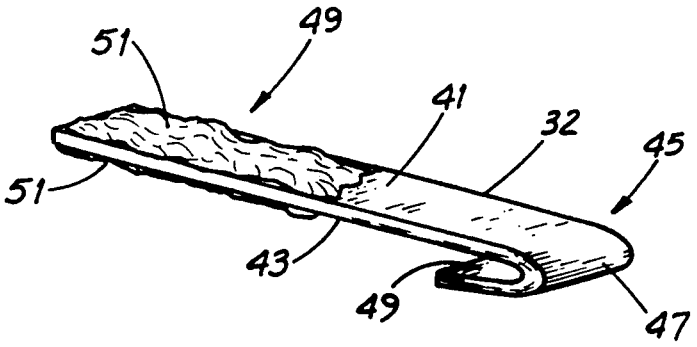
FIG. 3 is a perspective view of a hook which may form a part of the new gutter shield assembly.

Referring next to FIG. 3, each hook 32 is preferably formed of a generally flat, strip-like material having a top surface 41 and a bottom surface 43. The lower end 45 of the hook 32 is curved and defines a bight 47 and an opening 49 for removably attaching the hook 32 to the barrier 29. Preferably, the width of such opening 49 is selected to be slightly greater than the diameter or maximum thickness of the strands 39 of the barrier 29. This permits the hook 32 to be quickly and easily attached to and removed from the barrier 29. As further described below, the hooks 32 are attachable to shingles 15 without the use of adhesives or nails or other fasteners which destroy the integrity of the water-shedding surface of the singles 15. Therefore, a highly preferred hook 32 has a smooth top surface 41 and bottom surface 43, i.e., is devoid of perforations, indentations and nail holes.

The upper end 49 of the hook 32 is coated with a soft deformable material 51, the details of which are described below. Such material 51 is applied only to the top surface 41, only to the bottom surface 43 or, in a highly preferred embodiment, to both surfaces 41, 43. When the hook 32 is inserted in the thin space 53 between adjacent courses 17, 19 of shingles 15 as shown in FIGS. 1 and 2, the rough or textured surface of the shingle 15 adjacent a surface 41 or 43 of the hook 32 "bites into" and engages the soft material 51. Such engagement together with the slight pinching or clamping force applied to a hook 32 by the shingles 15 positionally retains each hook 32 between such partially overlapping shingles 15.

A highly preferred material 51 is a water or petroleum based coal tar or asphalt emulsion. Such emulsion is selected to assure that it is miscible with the material 51 from which the shingles 15 are made. Another useful material 51 is made by Johns-Manville Company and widely sold under the brand name "Duxseal." The material 51 is applied with sufficient thickness to permit good engagement with the rough surface of a shingle. Such material 51 is somewhat soft at room temperature and tends to further soften at elevated temperatures. For example, the heat generated by sunlight striking a roof 11 will further soften the material 51, thereby permitting the adjacent rough surface of the shingle 15 to further bite into the material 15 and positionally secure the hook 32. It is to be appreciated that the aforementioned deformable material 51 is not an adhesive in the sense that such material 51 does not permanently attach a hook 32 to a shingle 15. Rather, when the assembly 10 is constructed in accordance with the invention, such hooks 32 may be removed with little effort and may just as easily be replaced.

Attachment of the assembly 10 is further facilitated by the use of lower tabs 55 formed at intervals along the length of the barrier 29. A preferred interval is about 1-2 feet between tabs 55. Such tabs 55 are formed by severing strands 39 at the fourth side of an opening 33 adjacent the lip 31 are left intact to form a "hinge." After the barrier 29 is positioned atop the gutter 25, tabs 55 are bent downward and inward to engage the interior edge 62 of the lip 31.

In another preferred embodiment, the assembly 10 includes upper tabs 59 formed generally in the manner described above by severing strands 39 adjacent the shingle extension 21. After the barrier 29 is positioned atop the gutter 25, the tabs 59 are bent downward and rearward to engage such extension 21. The tabs 59 may be used in addition to or in lieu of the hooks 32 to secure the assembly 10. If the roof 11 has but a single layer of shingles 15, such tab 59 is bent to engage the underside of the extension 21. On the other hand, if the roof 11 includes two layers of shingles 15 (as may be found on once-reshingled buildings), the tab 59 is preferably bent to be inserted in the interstice between layers.

Installation of the improved gutter assembly 10 is extremely simple. The barrier 29 is first laid atop the gutter 25 and the roof 11 in a position such that the lower edge 37 of the barrier 29 is generally parallel to and overlaps and extends beyond the front lip 31 as shown in dotted outline in FIG. 1. The upper boundary 35 of the barrier 29 is positioned to overlap a substantial portion of the exposed upper surface 23. When hooks 32 are used, the upper end 49 of a hook 32 is a urged into the thin space 53 between overlapping shingles 15 and as such hook 32 is urged upward in a direction generally parallel to the roof 11, its curved end 45 is hooked into an opening 33 in the barrier 29.

Successive hooks 32 are similarly installed in spaced apart locations as shown in FIG. 1. Following installations of the hooks 32, the lower edge 37 of the barrier 29 is bent downward and around the front lip 31. The shield assembly 10 is thereby secured to the roof 11 and the rain gutter 25 without the use of adhesives, nails or other shingle-piercing fasteners. As described above, the tabs 59 may be used in addition to or in lieu of the hooks 32 for attachment.

In the unlikely event that clogging debris enters the trough 27, the lower boundary 37 of the barrier 29 is bent outward away from the lip 31 and the barrier 29 is folded upward to gain access to the trough 27 for cleaning purposes. In the alternative, the hooks 32 may also be withdrawn from the spaces 53 and the entire barrier assembly 10 removed. Of course, where tabs 59 are used for attachment, such tabs 59 are disengaged from the extension 21. Following cleaning, the assembly is reinstalled as described above.

In yet another embodiment, the shield assembly 10 is permanently installed when the roof is installed. When laying a new roof, a "starter strip" of material is laid adjacent the lower edge of the roof 11 and parallel thereto, a known technique. The upper edge of the exposed upper surface 23 is placed atop such starter strip and the first course 17 of shingles 15 is then laid atop the surface 23. When so attached, neither the hooks 32 nor the upper tabs 59 are needed to secure the assembly 10 to the roof. This is so since the upper surface 23 will be tightly "clamped" or confined between the starter strip and the first course 17 of shingles 15. However, tabs 55 and the lower boundary 37 bent around the front lip 31 are desirably used for attachment.

While the principles of this invention have been described in connection with specific embodiments, it should be understood clearly that these descriptions are made only by way of example and are not intended to limit the scope of the invention.

I claim:

1. An improved gutter shield for attachment to a roof including a first course of extending shingles and a rain gutter having a front lip with an interior edge including:

a barrier of stranded, mesh-like material having openings permitting the passage of water into the gutter;

the mesh-like material including an edge along the barrier bent to overlap and engage the front lip;

a plurality of tabs spaced from one another and formed by severing strands of the mesh-like material, at least one tab bent under and in engagement with the interior edge;

whereby the shield may be attached and removed without impairing the rain-proof integrity of the roof.

2. The gutter shield of claim 1 including at least one imperforate generally J-shaped hook having an upper end with upper and lower surfaces, at least one such surface coated with a soft deformable, non-adhesive material securing the assembly to the roof.

3. The gutter shield of claim 1 wherein plural tabs are bent to engage the interior edge.

4. The gutter shield of claim 3 wherein at least one tab is bent under and in engagement with one of the singles.

5. The gutter shield of claim 4 wherein plural tabs are bent under and in engagement with the singles.

6. The gutter shield of claim 2 wherein both such surfaces are coated with such non-adhesive material.

* * * * *

UNITED STATES PATENT AND TRADEMARK OFFICE

CERTIFICATE OF CORRECTION

PATENT NO. : 5,092,086

DATED : March 3, 1992

INVENTOR(S) : Albert Rognsvoog, Sr.

It is certified that error appears in the above-identified patent and that said Letters Patent is hereby corrected as shown below:

In column 4, line 38, after "construct" insert --the barrier 29 so long as at least some of the openings--.

Signed and Sealed this

Thirteenth Day of July, 1993

*Attest:*

Michael K. Kirk

MICHAEL K. KIRK

*Attesting Officer*

*Acting Commissioner of Patents and Trademarks*